US005136833A

United States Patent [19]

Inger

[11] Patent Number: 5,136,833

[45] Date of Patent: Aug. 11, 1992

[54] METHOD AND APPARATUS FOR REMOVING YARN PACKAGE AND TRANSPORT ADAPTER FROM A SPINDLE ASSEMBLY OF A YARN PROCESSING MACHINE AND SECURING THE FREE END PORTION OF YARN FOR TRANSPORT

[75] Inventor: Siegfried Inger, Tönisvorst, Fed. Rep. of Germany

[73] Assignee: Palitex Project Company GmbH, Krefeld, Fed. Rep. of Germany

[21] Appl. No.: 550,135

[22] Filed: Jul. 9, 1990

[30] Foreign Application Priority Data

Jul. 24, 1989 [EP] European Pat. Off. ..... 89113545.1

[51] Int. Cl.[5] ..... D01H 9/00; D01H 9/10; D01H 9/14

[52] U.S. Cl. ..... 57/269; 57/266; 57/270; 57/276; 57/278; 57/281; 57/58.52; 242/35.6 E

[58] Field of Search ..... 57/266, 268–271, 57/274–276, 278, 281, 58.52; 242/35.6 E

[56] References Cited

U.S. PATENT DOCUMENTS

| | | | |
|---|---|---|---|
| 3,813,866 | 6/1975 | Goldammer et al. | 57/275 |
| 3,945,184 | 3/1976 | Franzen | 57/58.7 X |
| 4,598,869 | 7/1986 | Uchida et al. | 57/276 X |
| 4,711,081 | 12/1987 | Frentzel-Beyme et al. | 57/279 |
| 4,759,175 | 7/1988 | Inoue | 57/58.83 X |
| 4,848,077 | 7/1989 | Kawarabashi et al. | 57/269 X |
| 4,901,931 | 2/1990 | Mista | 242/35.6 E X |
| 4,928,476 | 5/1990 | Otoshima et al. | 57/281 X |
| 4,979,360 | 12/1990 | Kallmann et al. | 57/270 X |
| 5,037,036 | 9/1991 | Okuyama | 242/35.6 E |
| 5,062,261 | 11/1991 | Fink | 57/281 |

FOREIGN PATENT DOCUMENTS

| | | |
|---|---|---|
| 2612660 | 4/1977 | Fed. Rep. of Germany . |
| 2646921 | 12/1977 | Fed. Rep. of Germany . |
| 2505882 | 11/1982 | Fed. Rep. of Germany . |
| 3824998 | 2/1989 | Fed. Rep. of Germany . |

*Primary Examiner*—Daniel P. Stodolo
*Assistant Examiner*—William Stryjewski
*Attorney, Agent, or Firm*—Bell, Seltzer, Park & Gibson

[57] ABSTRACT

For an automated removal of a package and transport adapter with a hollow core, on which at least one empty winding tube or a winding tube holding a residual length of yarn is inserted, from a yarn processing station, in particular from the protective pot of a two-for-one twisting spindle, the present invention provides for an operating method and an apparatus, so as to obtain for a troublefree further transportation of the package and transport adapter a yarn length of a defined length from the yarn end extending to a not-fully unwound winding tube, which yarn length is inserted into the hollow shaft of the package or transport adapter.

18 Claims, 8 Drawing Sheets

23
10
f5
f1
5.1'
5'
22
22.2
5.1
5
7
22.1
6'
B
8
6'
8.1
30
33
19
32
31
29
1
28
1.1
27
36
35
f6
34

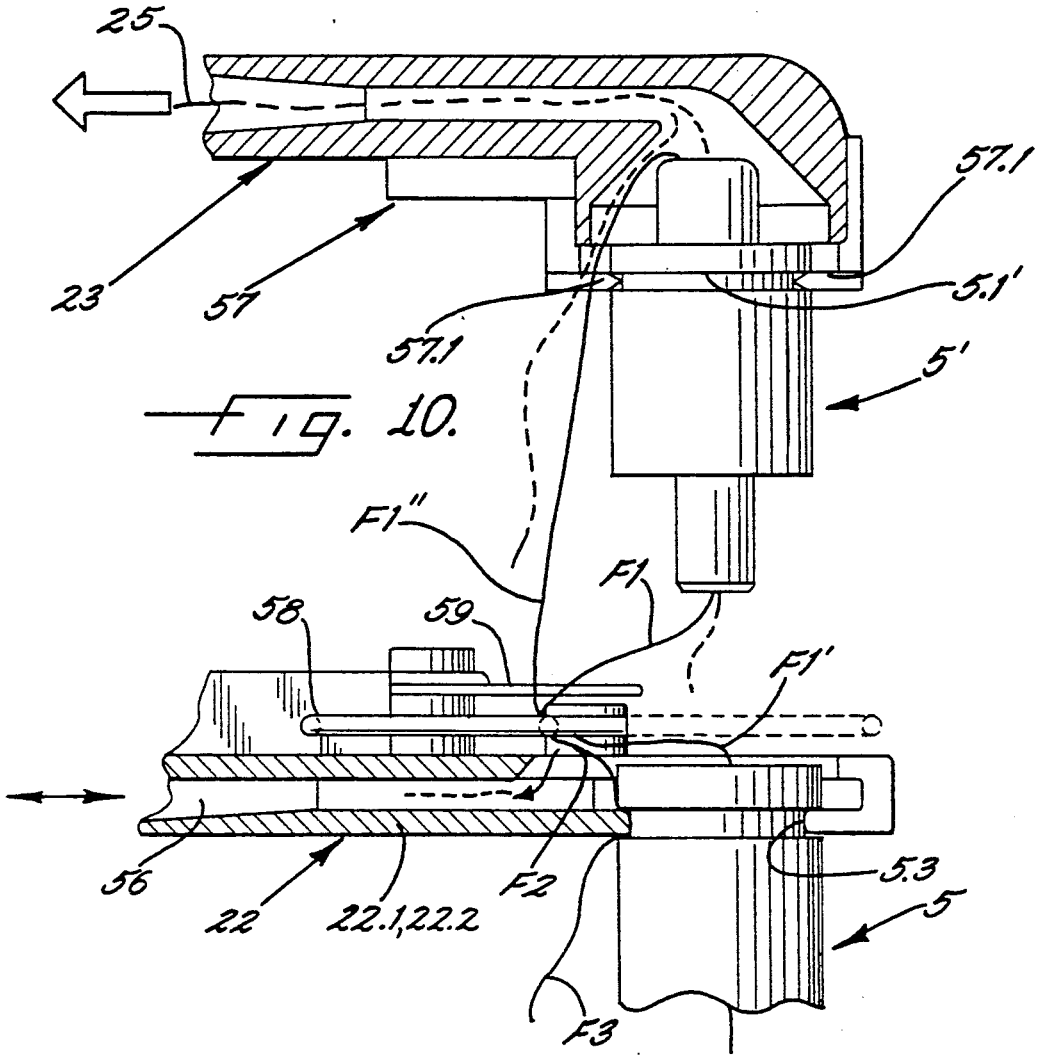
Fig. 10.
Fig. 11.
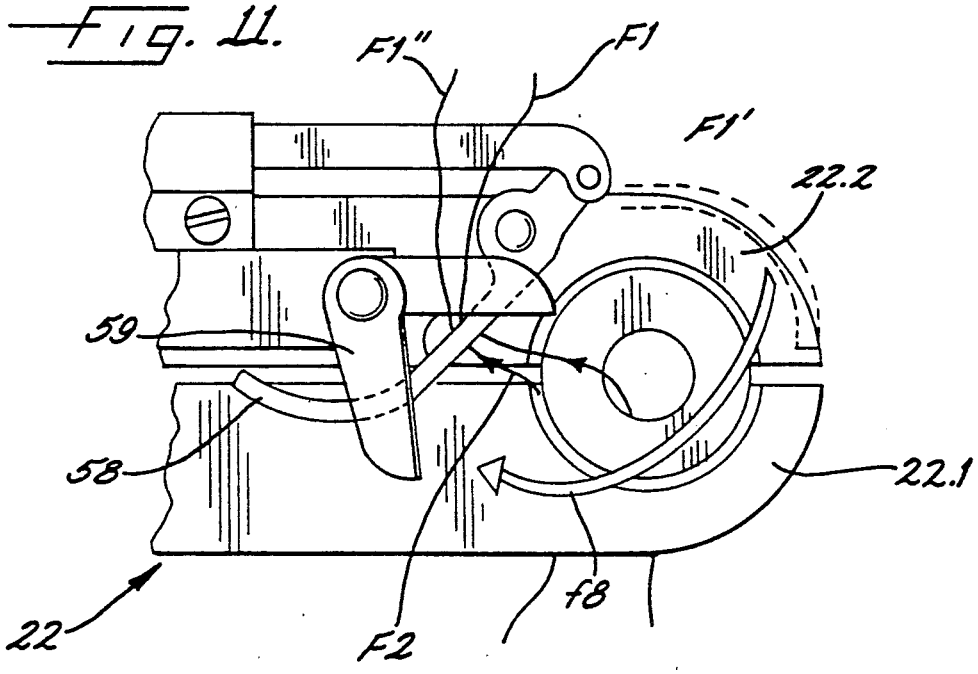

METHOD AND APPARATUS FOR REMOVING YARN PACKAGE AND TRANSPORT ADAPTER FROM A SPINDLE ASSEMBLY OF A YARN PROCESSING MACHINE AND SECURING THE FREE END PORTION OF YARN FOR TRANSPORT

FIELD OF THE INVENTION

This invention relates to a method and apparatus for removing the carrier and transport adapter carrying a hollow yarn supply package from the spindle assembly of a textile yarn processing machine, preferably a two-for-one twister, after yarn processing and for securing a free end portion of yarn which extends from a residual amount of yarn on the substantially empty supply package for transport away from the spindle assembly.

BACKGROUND OF THE INVENTION

When one of two cross-wound packages of a single feed yarn is unwound on a two-for-one twisting spindle, the following situation will primarily arise with respect to the yarn ends.

Only in relatively rare cases will it be possible to adapt the yarn lengths of the two cross-wound packages inserted into a two-for-one twisting spindle one to the other in such an accurate manner that they also unwind simultaneously, and that thus only the unwound tubes remain in the twisting spindle. Predominantly, one has to assume that while one package is fully unwound, some yarn is still left on the second package.

During the two-for-one twisting process, the twisted yarn is subjected in the yarn balloon to a constantly high tension corresponding to the yarn count and the spindle speed. When, after the complete unwinding of one feed yarn package, only one yarn component continues to pass through the yarn balloon, same will normally not withstand the yarn tension, and will tear. Should this not occur, monitoring devices are arranged in the further yarn path, which detect the single yarn, trigger a corresponding signal and either stop the spindle or, however, retain the yarn by clamping as it enters into the spindle, or inside the spindle.

This remaining and broken single yarn, which advances from the upper or the lower feed yarn package, continues to proceed to the apex of the hollow spindle shaft, advances through the hollow spindle shaft, and terminates mostly on the external rim of the spindle rotor on the storage disk.

When now an empty or almost empty unwinding unit is removed from the two-for-one twisting spindle (no matter whether by hand or a handling device), the yarn end, which is pulled out of the hollow spindle shaft, will fly freely and vagabond from the center of the creeling device (adapter).

In the further handling of the unwinding unit, the freely flying yarn will not only be a hazard, for example, to the two-for-one twisting spindles operating in the direct vicinity, but also for the handling and motional operations within a maintenance and handling device.

Likewise unsecured is the yarn end, which is located between the wind on the package and the apex of the adapter, and same may loosen as a result of external circumstances such that it will cause impediments.

However, yarns twisted by the two-for-one twisting process are also made from an assembly wound feed yarn package. The two yarn strands which participate in the twisted yarn, are previously doubled (plied) on an assembly winder and wound onto a single package.

Normally, one can presume that the assembly-wound packages unwind completely and that therefore no yarn remnants are left on the assembly winding tube. However, practice shows, that shortly before the complete unwinding of an assembly wound package, yarn remnants are occasionally left on the tube. The reason therefor is to be found in the initial winding on the assembly winder, where the initial yarn layers often engage with one another. The consequence is a yarn break on the two-for-one twisting spindle and thus a yarn remnant on the assembly winding tube.

OBJECT AND SUMMARY OF THE INVENTION

It is the object of the present invention, to avoid the above-outlined negative features of yarn remnants or vagabonding yarns in connection with the operation of the an automatic maintenance device on a two-for-one twisting spindle.

This object is accomplished by this invention by providing a method for securing a free end portion of yarn extending from a residual amount of yarn on a package tube carried by a hollow carrier and transport adapter during removal thereof from a spindle assembly of a two-for-one twister textile yarn processing machine after processing of the yarn from the package to prepare the adapter and yarn package tube thereon for transport away from the spindle assembly. The method includes the steps of cutting the free end portion of yarn extending from the yarn package tube to a desired length, and inserting at least the terminal part of the cut length of the free end portion of yarn into the hollow interior of the carrier and transport adapter for securing same. The method preferably further includes the steps of clamping an intermediate part of the free end portion of the yarn prior to and during the cutting step and the inserting step, and removing by suction the cut-off part of the free end portion of the yarn.

The hollow yarn package carrier and transport adapter may be of an axial upper and lower two piece construction in which the upper piece contains therein a part of the free end portion of the yarn during removal of the adapter from the spindle assembly and the lower piece carries the yarn package and receives the inserted terminal part of the cut free end portion of the yarn for securing same. The clamping step may further include clamping an intermediate part of the free end portion of the yarn at the upper region of the lower piece of the adapter and the cutting step may be performed at a part of the free end portion of the yarn between the clamped part and the upper piece of the adapter. Thereafter, the upper piece of the adapter is separated from the lower piece of the adapter prior to inserting the cut piece of the free end portion of yarn into the hollow interior of the adapter for securing same. The clamping step may further include clamping an intermediate part of the free end portion of the yarn prior to and during the cutting step at a second location at the upper piece of the adapter and the cutting step may be performed at a part of the free end portion of the yarn between the clamped yarn parts. The clamping at the upper piece of the adapter is removed after cutting for performing the step of removing the cut-off part of the free end portion of the yarn.

The apparatus of this invention which may be used in the above described method includes movable gripper arm means for moving to the spindle assembly and gripping the adapter on the outer circumference at an upper end thereof above the yarn package and for moving away from the spindle assembly for removing therefrom the adapter and substantially empty yarn supply package. Cutting means are provided for cutting the free end portion of the yarn extending from the substantially empty yarn supply package to a desired length prior to removing the adapter and substantially empty yarn package from the spindle. Movable suction arm means are provided for moving to the spindle assembly and into position at the upper end of the adapter and above the gripper means for removing the cut-off part of the free end portion of the yarn after cutting. Compressed air injector yarn threading means are provided in the hollow spindle of the spindle assembly of the yarn processing machine which may be used for inserting at least the terminal part of the cut length of the free end portion of the yarn and into the hollow interior of the adapter for securing same. Preferably, the yarn processing machine includes a plurality of spindle assemblies positioned in side-by-side relationship longitudinally of the yarn processing machine, and a maintenance device mounted for movement longitudinally along the yarn processing machine and to each of the spindle assemblies and for carrying the movable gripper arm means and the movable suction arm means for upward and downward movement in the vertical direction and inward and outward movement in the horizontal direction. Other details and features of the apparatus of this invention will become evident from the following detailed description of preferred embodiments of the invention.

BRIEF DESCRIPTION OF THE DRAWINGS

The invention will be described below in more detail with reference to the drawing, in which

FIG. 10 is a sectional view of a modified embodiment of the apparatus of the present invention; and and handling elements shown in FIG. 10.

DETAILED DESCRIPTION OF PREFERRED EMBODIMENT OF THE INVENTION

Figure 1:
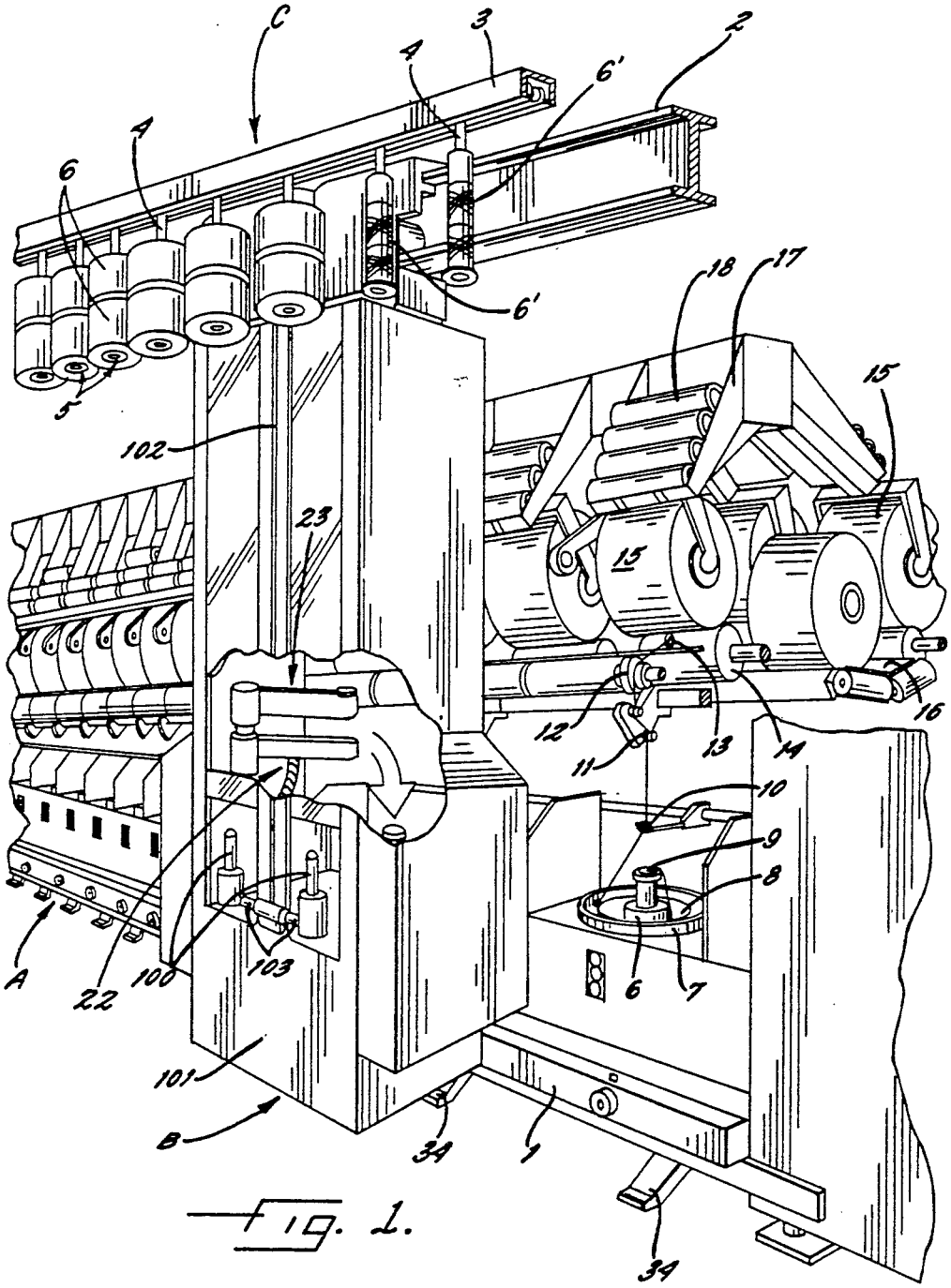
FIG. 1 is a perspective, fragmentary view of a two-for-one twister with an automatic maintenance device patrolling along this machine.

FIG. 1 is a detail view of a two-for-one twister A, an automatic maintenance unit B traveling along the two-for-one twister along lower and upper rails 1 and 2, and an overhead conveyor C.

The overhead conveyor C comprises an upper rail 3, along which a conveyor belt moves with evenly spaced-apart, downward directed suspension holders 4 for package adapters or package transport adapters 5 attached thereto. The suspension holders 4 and package adapters 5 are constructed in known manner so that during a first upward movement of a package adapter 5, the latter is grasped and held by the suspension holder, and released therefrom during a subsequent upward movement and lowering relative to the suspension holder 4. FIG. 1 shows in the region of the upper rail 3, on the left side, six package adapters 5, each loaded with two fully cross-wound packages or feed yarn packages 6, which are to be delivered by the automatic maintenance device B to the individual twisting positions 7 of the two-for-one twister A, and on the right side, two package adapters 5, each holding two empty or almost empty tubes 6', which were individually removed by the automatic maintenance device B from the twisting positions of the two-for-one twister and delivered to a suspension holder 4. These tubes 6', which may still carry some residual yarn, are transported together with the package and transport adapters 5 by means of the overhead conveyor C to an external loading station, where the adapters 5 can again receive fully wound feed yarn packages or cross-wound packages 6.

The two-for-one twister comprises a plurality of working or twisting positions with the usual elements, such as a spindle (not shown) in the lower portion, balloon limiter 7, protective pot 8, yarn inlet end 9, balloon yarn guide 10, deflecting elements 11 for controlling the yarn winding tension, overfeed element 12, traversing yarn guide 13 and a cross-wound package of the twisted yarn or takeup package 15 driven by a friction roll 14. In the center of the machine, a conveyor belt 16 extends in the upper region between the two parallel machine sides for the removal of fully wound packages 15 of the twisted yarn. Located above each cross-wound package of the twisted yarn or takeup package 15, which is driven by friction roll 14, is a magazine 17 for empty takeup tubes 18.

Shown inside the protective pot 8 is an upper, only partially cross-wound package or feed yarn package 6 of a pair of feed yarn packages which are inserted by means of a package adapter 5. From the feed yarn packages, the yarns are withdrawn upward and guided through the yarn inlet end 9 into the lower spindle portion to a storage disk, whence the two combined yarns advance to a balloon yarn guide 10 while forming a yarn balloon, and subsequently, after passing deflection rolls 11 and overfeed roll 12, onto a takeup package 15 driven by friction roll 14.

The automatic maintenance device B routinely travels in front of the two-for-one twister or its individual twisting positions respectively. FIG. 1 shows a schematic detail view of the different handling elements of the maintenance device B, which serve to exchange a package adapter 5 (unwound unit) loaded with empty winding tube 6, for a package adapter 5 (feed yarn unit) loaded with fully cross-wound packages 6, and to manipulate or secure the yarn ends of the almost empty winding tubes 6, These handling elements comprise primarily two mandrels 100, which are adapted to rotate about a vertical axis and to move upward and downward in vertical direction to receive feed yarn units and unwound units, as well as gripping and suction means 22 and 23 respectively. These elements will be described with reference to FIGS. 5–11.

The maintenance device B comprises a cabine-shaped housing 101, whose front wall is provided with a guide rail 102 for a rotatable cross arm 103 carrying a the mandrels 100.

Pedals 34 below each twisting position serve for a preparatory actuation or respectively maintenance of the individual twisting positions.

The following will describe both the constructional details and the steps of the method according to the present invention as well as the functions of the individual elements of the present invention.

Figure 2:
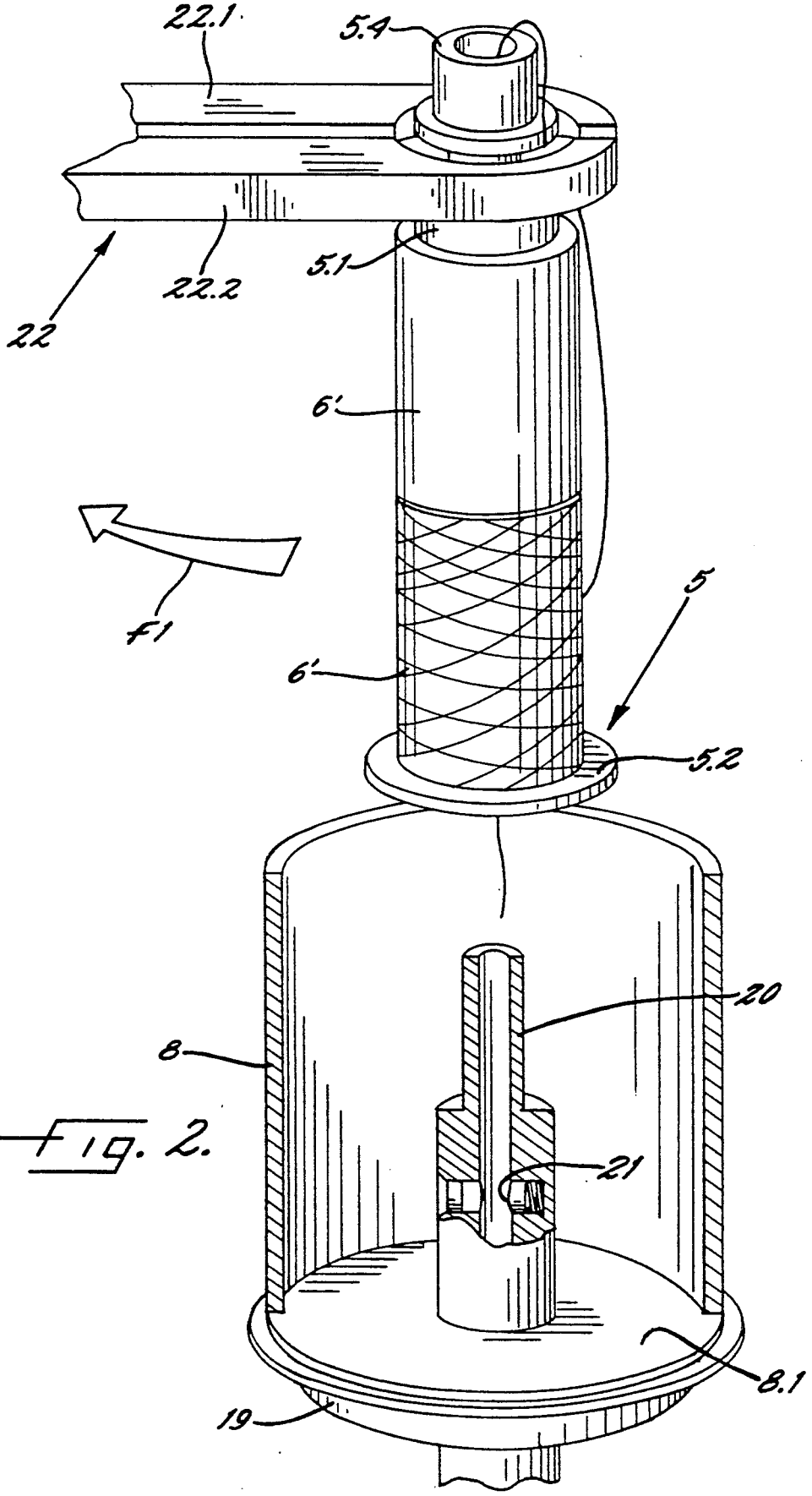
FIG. 2 is a partially sectional and a partially perspective detail view of a two-for-one twisting spindle with an associated package or transport adapter and parts of the maintenance device of the present invention.

FIG. 2 illustrates a simplest suggestion for the removal of an unwinding unit, comprising a package adapter 5 and including empty or almost empty winding tubes 6', from the protective pot s of a two-for-one twisting spindle, and the securing of the yarn ends still participating in the process. FIG. 2 also shows the bottom 8.1 of the protective pot of a two-for-one twisting spindle, the usual yarn storage disk 19, the yarn inlet tube 20 as well as a schematically illustrated yarn brake 21 in the interior of the yarn inlet tube 20. The package adapter 5, which, as was described above, is simultaneously also the transport adapter, comprises (see also FIG. 3), a cylindrical portion 5.1, which is provided with a carrying flange 5.2 at its lower end and, preferably, with an annular groove 5.3 in the region of its upper end. The upper end of the cylindrical portion 5.1 is followed by a cylindrical connecting piece 5.4 having a smaller diameter in comparison therewith.

An upward and downward movable gripper 22 of the maintenance device B, which is provided with gripper arms 22.2 and 22.2 and adapted to rotate in the horizontal direction (arrow f1), serves to remove the unwound unit from the two-for-one twisting spindle. The ends of the two gripper arms 22.2 and 22.2 are able to enclose the package adapter 5 inserted in protective pot 8 on its outer circumference, preferably, however, in the region of its annular groove 5.3, thereby automatically clamping and securing at the same time the yarn end, which advances from the not-fully unwound lower winding tube 6, and enters into the hollow shaft of the package adapter. In this instance, it is unnecessary to proceed with a further manipulation of the yarn end on the twisting spindle itself. It is only necessary to see, when the package adapter 5 is removed from the protective pot 8 by the upward movement of gripper 22, that the yarn brake 21 is automatically opened, thereby enabling the yarn end to be pulled out of the hollow shaft of the spindle without any impediment. In doing so, the yarn end itself remains in the interior of the package adapter.

Figures 3, 4:
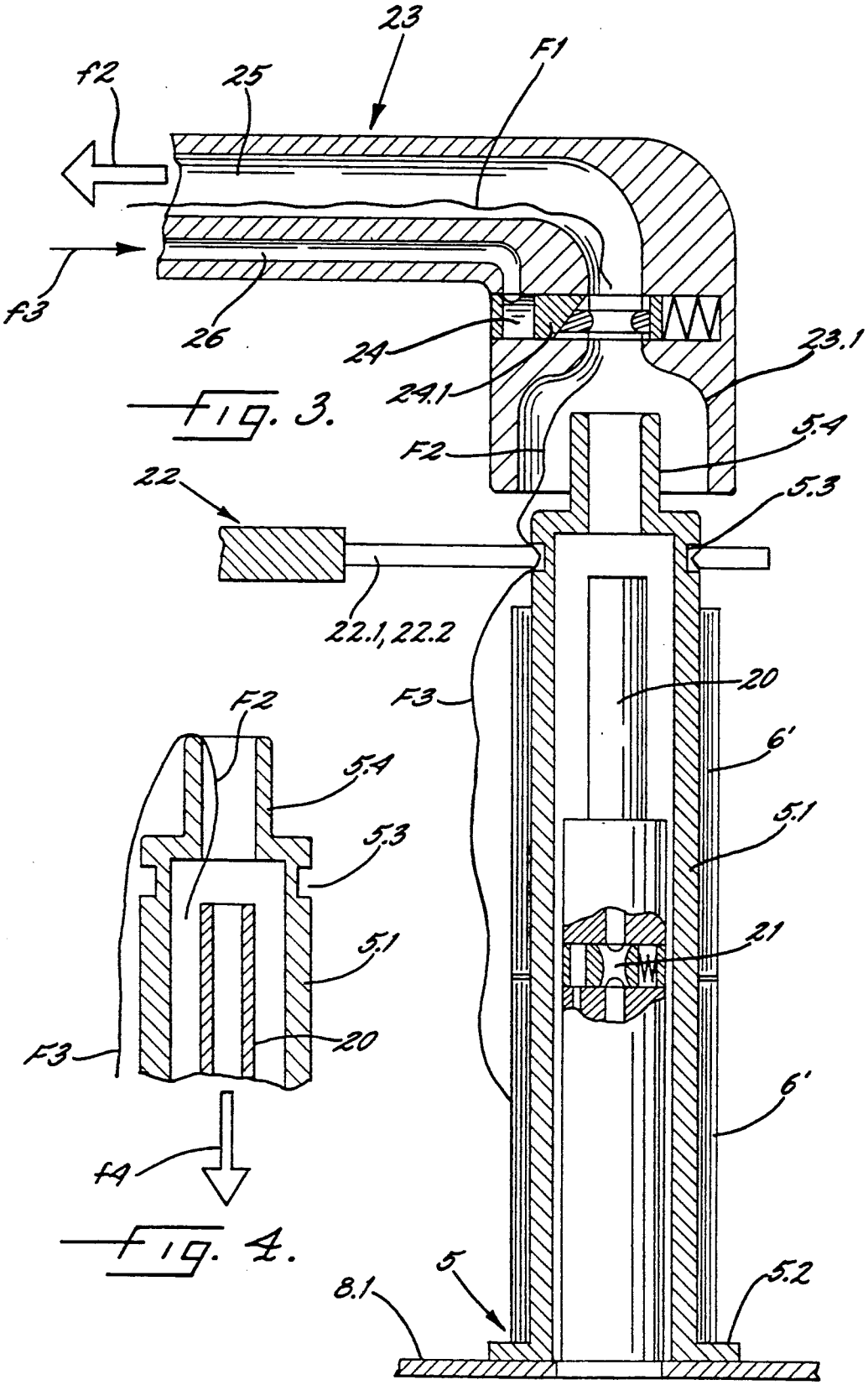
FIG. 3 is a sectional detail view of parts of a two-for-one twisting spindle with a package adapter inserted thereon and associated maintenance elements.
FIG. 4 it a sectional detail view of the upper spindle and adapter end.

In the embodiment of FIG. 3, a suction device 23 is provided in addition to the gripper 22, which includes a suction head 23.1 insertable over the upper side of the package adapter 5 with an integrated yarn cutter 24. Just as the gripper 22, this suction device 23 is one of the servicing and handling elements of the maintenance device B. The two servicing elements 22 and 23 are adapted for rotation about a common axis inside the maintenance device B and further adapted for an upward and a downward movement in vertical direction.

For the different yarn lengths, the following definition will apply, for example in accordance with FIG. 3:

F1—and hereinbelow F1' and F1''—is or respectively are sucked away as the outermost yarn length after the actuation of a cutting device;

F2 as an intermediate yarn length is inserted with a defined length at least in part into the hollow shaft of the adapter; and

F3 as an innermost yarn length sets up the connection between the still partially wound winding tube and the yarn length F2, and corresponds to the yarn length between this winding tube and a clamping point in the upper edge area of the package or transport adapter.

In the embodiment of FIG. 3, the package adapter 5 is grasped by means of the gripper arms 22.1 and 22.2, thereby clamping and securing in position the yarn end length F1+F2+F3 advancing from the winding tube 6' in the region of the annular groove 5.3 between the two yarn lengths F2 and F3. By supplying suction air (arrow f2) through a suction line 25 leading to the suction head 23.1, the yarn end lengths F1+F2, which are in the hollow shaft of the spindle according to FIG. 2, are sucked out of the hollow spindle shaft into the suction line 25 after opening the yarn brake 21. The presence of a yarn end sucked into line 25 is scanned by means of a sensor not shown, whereupon the cutter 24 is actuated by means of compressed air (arrow f3), which is supplied through a channel 26. A key part of the yarn cutter is a piston 24.1 with a Cutting edge movable against the force of a spring. The cut-off yarn length F1 in the suction line 25 is transported to a waste container not shown. Subsequently, the yarn length F2 which is connected with the residual yarn on the lower winding tube 6', is again sucked into the center of the package adapter by a suction air current (arrow f4), which is operative in the interior of the spindle. This condition is shown in FIG. 4.

Subsequently, the gripper 22 lifts the package adapter 5, including the unwound tubes 6, out of the two-for-one twister spindle, thereby clamping the yarn length F3, which extends from the apex of the adapter to the tube 6', and delivers the entire unwound unit to the maintenance device B for further treatment or handling.

The following proposed solutions are based on package adapters, which are bipartite. The lower portion of the adapter presents a transport means for the fully wound packages or the unwound tubes. In this form, it is also a part of the transport system superposed on the two-for-one twister. In the two-for-one twisting spindle, i.e. inside the protective pot, the lower portion of an adapter serves simultaneously to center the packages on the hub of the protective pot.

Excepting the additional upper cylindrical connecting piece 5.4, the lower portion of such a bipartite package adapter corresponds to the package adapter 5 of FIGS. 2 and 3. For this reason, the lower portion of the package adapter illustrated in FIGS. 5–11 is also indicated at numeral 5. Placed on top of this lower portion of the adapter is a head piece or an upper adapter portion 5', which comprises a hollow shaft, and which serves in known manner to create different unwinding conditions for the yarn on a two-for-one twisting spindle. In the embodiments of FIGS. 5–8 and 10, the upper adapter portion 5' may, for example, be a yarn lubricating device of a known type, which forms the yarn inlet end and serves to moisten the yarn passing therethrough with a finishing agent.

Figure 5:
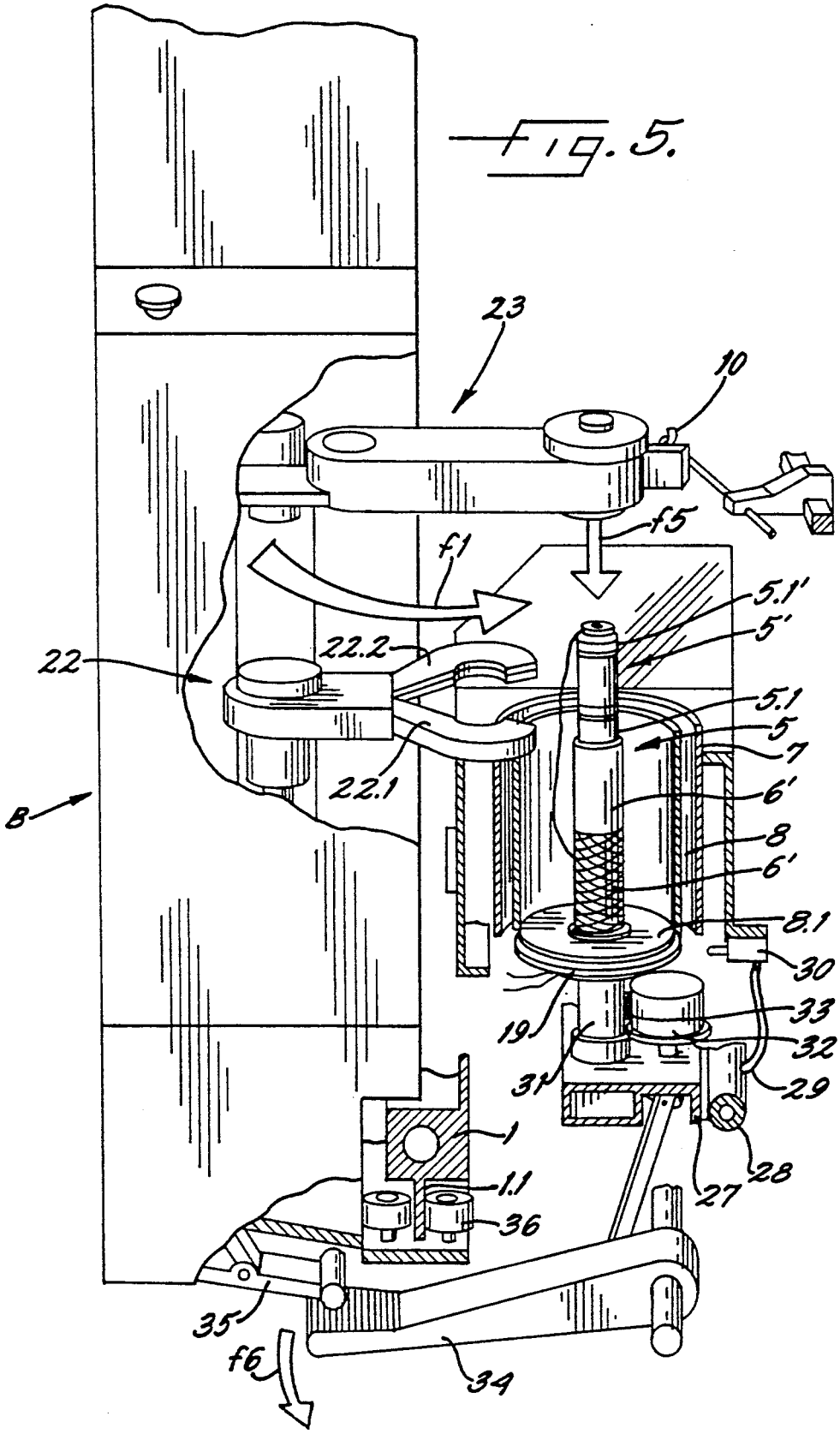
FIG. 5 is a partially sectional and partially perspective view of a two-for-one twisting spindle with maintenance and handling elements associated with an automatic maintenance device.

FIG. 5 is a cross sectional view of a portion of the two-for-one twister. More specifically, it shows a machine frame 27, a compressed-air line 28 with a connection 29 leading to a two-for-one twisting spindle via a compressed air nozzle 30 for the pneumatic threading of a yarn, and a spindle whorl 31 with a belt pressure roll 32 for pressing a tangential drive belt 33 against the whorl 31. A pedal 34 associated to each individual spindle serves to actuate a spindle brake not shown. This pedal 34 also serves to actuate the compressed-air nozzle 30, so as to build up in the hollow spindle shaft a suction air flow for the purpose of pneumatically threading a yarn through the spindle.

Furthermore, FIG. 5 illustrates portions of the maintenance device B, which routinely travels in front of the two-for-one twister along rails 1 and 2, and of which detail views of the servicing and handling elements relevant for the invention and/or the further description are shown, such as the gripper 22 and the suction device 23, as well as an actuation lever 35, which, when depressed in the direction of arrow f6, allows to actuate the pedal 34 at a given moment for stopping an individual spindle. FIG. 5 also illustrates, shortly above the pedal 34, two track rolls of the maintenance device B, which move along a guide surface 1.1 of the lower rail 1.

The suction device 23 as well as the gripper 22 are adapted to rotate in direction of arrow f1 and to vertically move upward and downward in direction of arrow f5.

As to FIG. 5, mention should also be made that once the suction device 23 is swung into the region of the spindle axis, the balloon yarn guide 10 is swung out of its coaxial position with the spindle.

Figure 6:
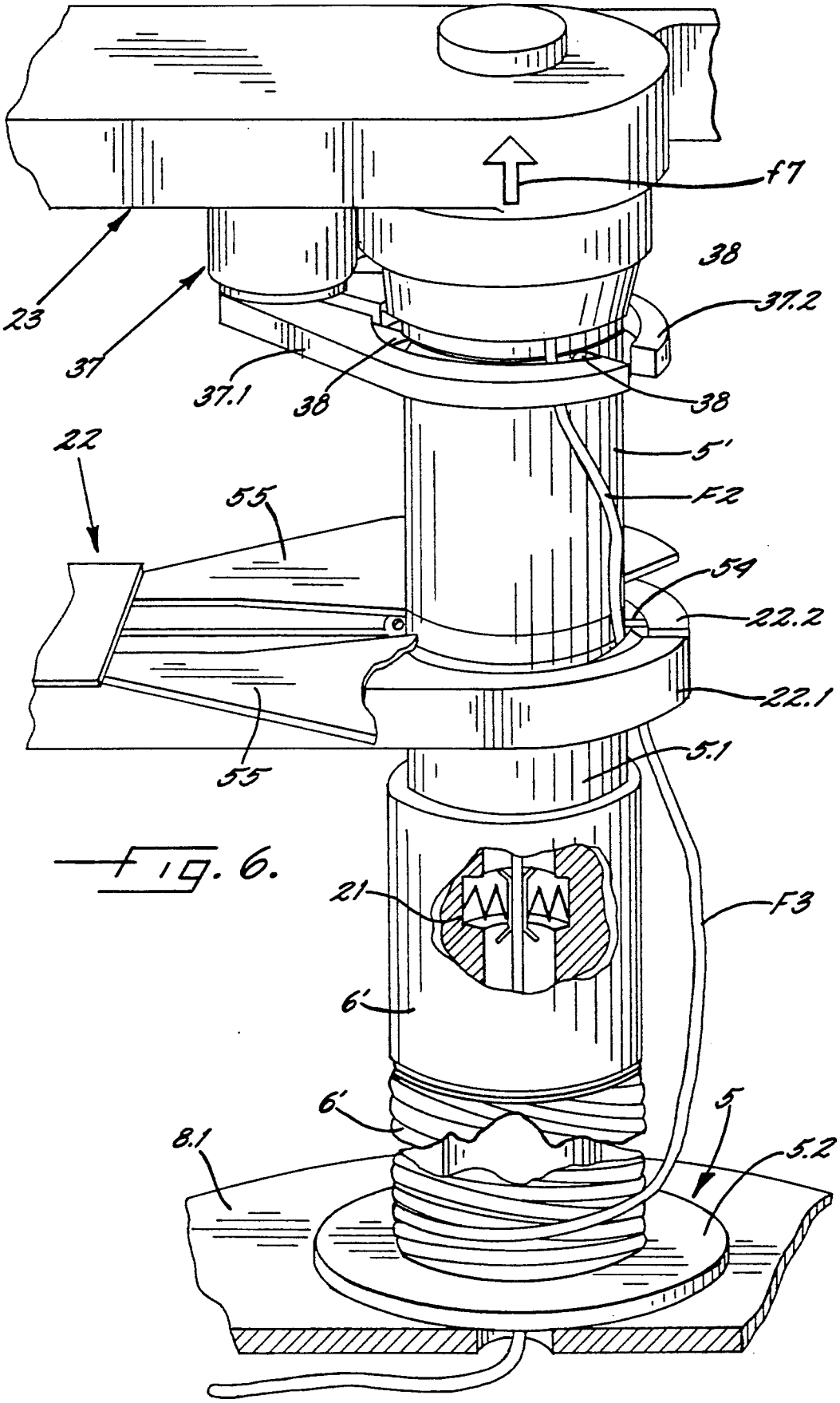
FIG. 6 is an enlarged, partially sectional and partially perspective view of parts of a two-for-one twisting spindle with an inserted, bipartite package adapter and associated maintenance and handling elements.

Shown in FIG. 6 is the rotated position of the gripper 22 or respectively its arms 22.2 and 22.2 above the spindle. The two gripper arms 22.2 and 22.2 rotatable relative to each other engage in annular groove 5.3 of the lower adapter portion 5. In so doing, the yarn end length advancing from the residual wind of one of the two tubes 6' is clamped between the yarn lengths F2 and F3, no matter in which position of the adapter circumference this yarn end length is located. As the gripper 22 is rotated to the area of the spindle axis, the suction device 23 is likewise moved to the area of the spindle axis. Arranged on the suction device 23 is an additional gripping device 37, which has two gripper arms 37.1 and 37.2 rotatable relative to each other. Whereas the two arms 22.1 and 22.1 of the lower gripper 22 are in a position to contact the bottom of the annular groove over their entire inside circumference, so that the yarn is clamped regardless of its circumferential position, the arms 37.1 and 37.2 of the upper gripper 37 are provided with inward directed projections or noses 38, which engage in point contact with an annular groove 5.1' of the upper adapter portion or yarn inlet head 5', when the gripper arms are closed. As a result, it is ensured that the yarn length F1+F2 traveling along the outside of the upper adapter portion 5' is not clamped in position by these gripper arms 37.1 and 37.2.

As is illustrated in FIG. 6, the residual quantity of yarn is on the lower tube 6', which is not shown in its entire length, whereas the yarn is fully unwound from the upper tube 6'. A partial view into the inside of this upper tube 6' reveals the yarn brake 21, which can be opened at a given moment (a detailed description will follow with reference to FIG. 7) controlled by the maintenance device, so as to be able to pull the yarn out of the hollow spindle shaft or the yarn entry tube 20 respectively. The lower adapter portion 5 is placed with its carrying flange 5.2 on the bottom 8.1 of the protective pot, which is shown in part.

Figure 7:
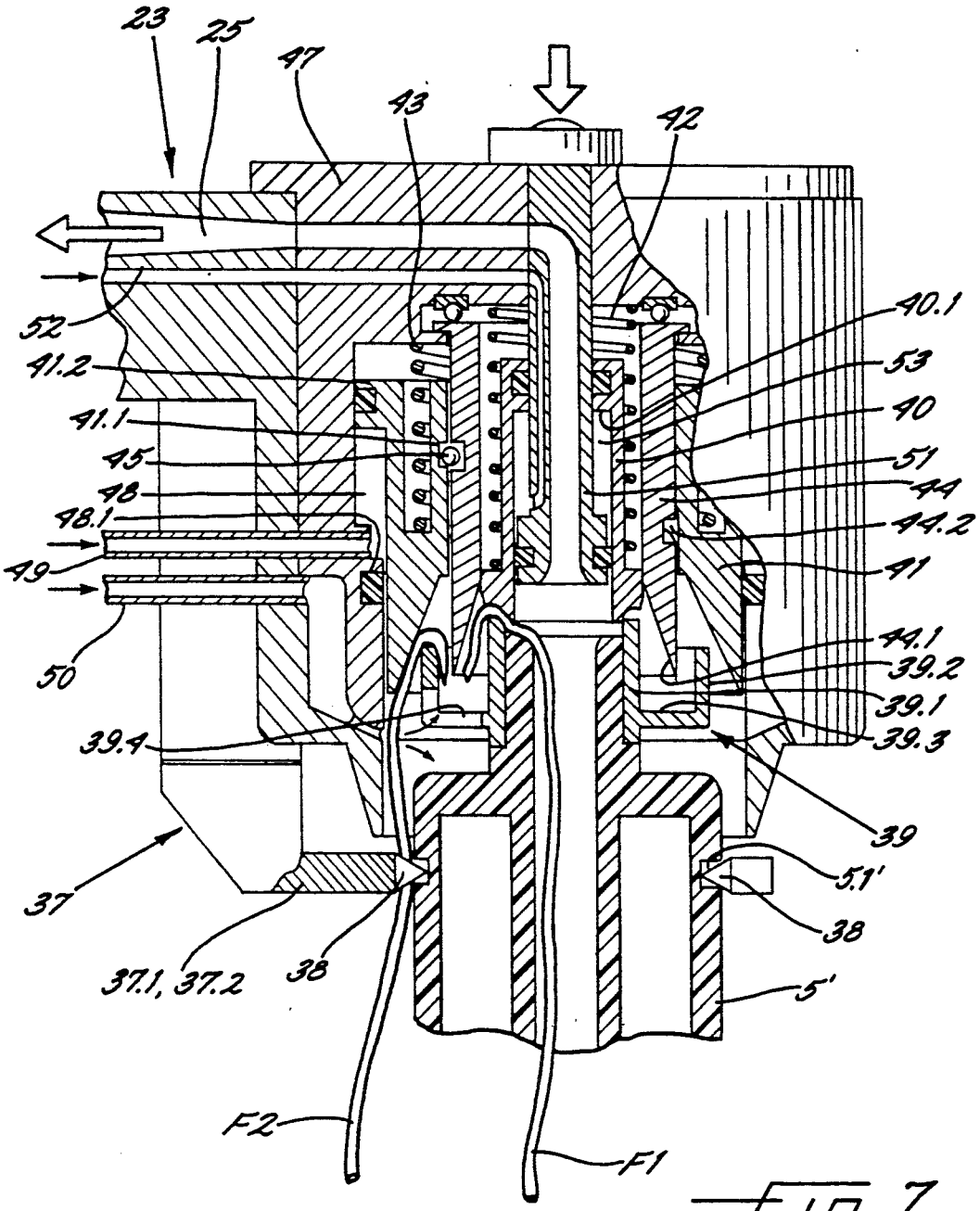
FIG. 7 is an enlarged sectional view of the upper handling and maintenance element illustrated in FIG. 6 in the form of a suction device.

Referring now to FIGS. 6 and 7, the description of the construction and operation of the upper, additional gripping device 37 in connection with the suction device 23, which is provided with additional clamping and cutting elements, is as follows: The primary task of this additional gripping device 37 and the suction device 23 is both to reliably remove and to secure in position the yarn end F1 inside the hollow spindle shaft as well as the yarn lengths F2+F3, which are still connected with the residual yarn wind on the one of the two tubes 6'.

To handle these yarn lengths F1 and F2, the suction device 23 is lowered from the top onto the upper adapter portion or inlet head 5'. Upon reaching the corresponding height, the previously opened gripper arms 37.1 and 37.2 are rotated inwardly. In so doing, the claws or projections 38 move into the annular groove 5.1' of the upper adapter portion 5' and come to lie against the bottom of the annular groove in a point contact therewith.

The inlet head or the upper adapter portion 5' accommodates an attachment 39, which comprises an inner cylindrical sleeve 39.1 and, radially spaced-apart therefrom, an outer cylindrical sleeve 39.2, the latter being connected with the inner cylindrical sleeve 39.1 by a flange 39.3 having at least one opening 39.4. The outer cylindrical sleeve 39.2 is less high than the inner cylindrical sleeve 39.1.

In its interior, the suction device 23 is provided with two annular clamping surfaces, so as to clamp the yarn lengths F1 and F2, which are still connected with each other at this time, first in the region of the upper edge of the inner cylindrical sleeve 39.1, and second in the region of the upper edge of the outer cylindrical sleeve 39.2. The clamping is effected by means of two concentric sliding sleeves 40 and 41 respectively, coaxial with the hollow spindle shaft and biased by springs 42 and 43 respectively. While the sliding sleeve 40 cooperates with the upper edge of the inner cylindrical sleeve 39.1, the outer sliding sleeve 41 having a downwardly flaring internal conical surface cooperates with the upper edge of the outer cylindrical sleeve 39.2.

Supported between the two sliding sleeves 40 and 41, which exert a clamping function, is a rotatable cutting sleeve 44 with a lower, annular cutting edge 44.1. This cutting sleeve 44 is provided on its outer circumference with a threadlike extending groove 44.2, which is opposed by a recess 44.1 provided in the inside wall of the outer sliding sleeve 41 for receiving a spherical body 45. The spherical body 45 is accommodated in part in the recess 41.1 and in part in the groove 44.2 such that the cutting sleeve 44 is put into rotation, when the sliding sleeve 41 is displaced relative to the cutting sleeve 44 in axial direction. At its end facing away from the cutting edge 44.1, the cutting sleeve 44 is supported by means of a bearing, preferably an axial grooved ball bearing.

At the same time as the suction device 23 is lowered and the yarn lengths F1 and F2 still being connected with each other are clamped by means of the sliding sleeves 40 and 41 on the upper edges of the cylindrical sleeves 39.1 and 39.2 respectively, the cutting sleeve 44 is put into rotation as a result of the forcible guidance—recess 41.1, spherical body 45 and groove 44.2—thereby cutting the still coherent yarn lengths F1, F2 into an outer yarn length (F1), and an intermediate yarn length (F2).

The outer sliding sleeve 41, in which first the cutting sleeve 44 and then the inner sliding sleeve 40 are embedded, is preferably accommodated in a cylindrical opening 48, which is formed as a stepped bore of the suction head 47 of suction device 23, with the portion of the stepped cylindrical opening 48 having a larger diameter being located at the inner or respectively blind end of the stepped bore, whereas the outer portion of the stepped bore having a smaller diameter opens toward the outside. Sealably guided in this outer portion of the stepped bore is the outer sliding sleeve 41. This sliding sleeve 41 is provided at its inner end with an outward directed annular flange 41.2, which is sealably guided in the interior portion of the stepped bore 48 having the larger diameter. In this manner, an annular cavity is formed between the annular flange 41.2 and the annular shoulder 48.1, in which a first compressed-air line 49 terminates. As soon as compressed air is supplied through this line 49 into the last-described annular cavity, the outer sliding sleeve 41 is displaced upward against the force of compression spring 43, so that the yarn length F2 is released and drops under the influence of gravity in direction of the lower gripper, the package adapter gripper 22. To assist the fall of the yarn length F2 out of the region of the clamping point, compressed air is supplied through a second line 50, which is followed by a system of channels leading to the opening 39.4 of the attachment 39. This compressed air serves simultaneously to clean the upper end of the upper adapter portion or inlet head 5'.

Subsequently, the suction device 23 moves upward together with the upper gripper 37 (arrow f7 in FIG. 6), thereby raising or pulling upward the upper adapter portion or inlet head 5' together with the inner yarn length F1, after the yarn brake 21 has automatically opened as a function of a control command from the maintenance device B.

Upon completion of the lifting operation, line 25 of the suction device 23 is supplied with suction air, which continues through a suction nozzle 51 extending centrically through the suction head 47 downward to the upper end of the upper adapter portion or inlet head 5' in such a manner that the yarn length F1 is sucked into this nozzle 51 and suction line 25, while still being clamped between the lower edge of the sliding sleeve 40 and the upper edge of the inner cylindrical sleeve 39.1. To be able to transport the yarn length F1 through the suction line 25 to a waste container not shown, the inner sliding sleeve is subsequently pushed upward against the pressure of spring 42, preferably by means of compressed air, which is injected through a third channel 52 into an annular cylindrical cavity 53 between the outside wall of the suction nozzle 51 and the inside wall of the sliding sleeve 40, which is provided to this end with an annular piston surface 40.1.

Figures 8, 9:
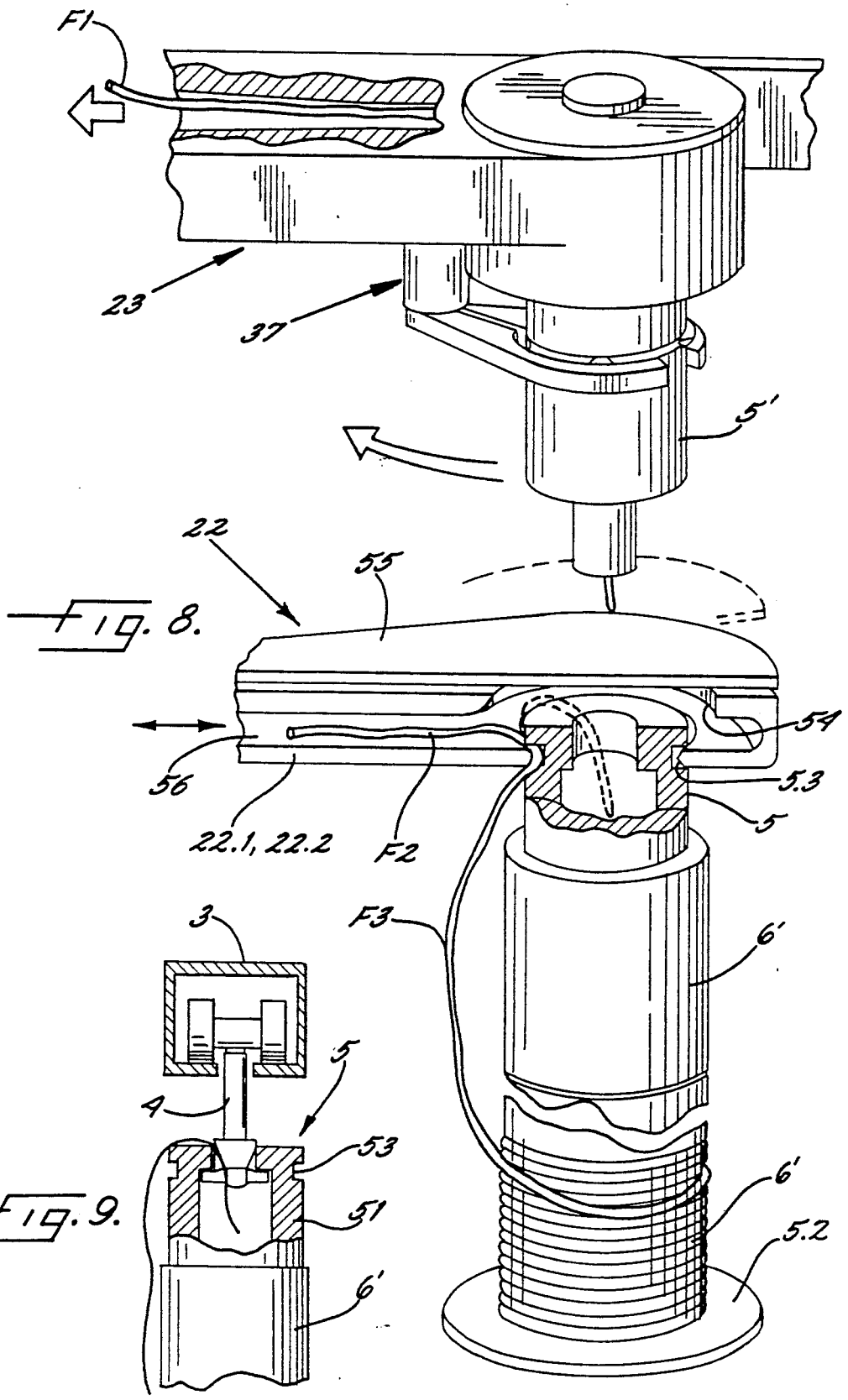
FIG. 8 is a partially sectional and partially perspective view of an arrangement according to FIG. 6 during a second handling step.
FIG. 9 is a sectional detail view of the upper portion of a transport adapter associated to a conveying device.

After the suction device 23 is raised together with the additional upper gripper 37, and after the suction air current has started, these two elements are in a position as is shown in the upper portion of FIG. 8.

All that is left now is to secure the yarn length F2 extending to one of the two tubes 6'. As is shown in both FIG. 6 and FIG. 8, the gripper arms engage with their clamping edges in the annular groove 5.3 on the upper end of the lower adapter portion or transport adapter 5, thereby clamping the yarn length F2. In a system, as shown in FIGS. 5–8, with a bipartite adapter, the lower gripper 22 comprises the actual gripper arms 22.2 and 22.2, which engage in annular groove 5.3 of the lower adapter portion or transport adapter 5 and clamp the yarn length F2 advancing from the residual yarn wind on a package.

As is shown in FIGS. 6 and 8, the lower gripper 22 is provided in the region of its arms 22.1 and 22.2 on the upper side with an opening 54 concentric with the adapter shaft. FIG. 8 shows only one half of the opening. According to FIG. 6, this opening 54 serves for the passage of the upper adapter portion of inlet head 5. As soon as the upper adapter portion 5' is raised from the lower adapter portion 5, the opening can be closed by means of rotatable flaps 55, so as to be able to seal an air channel 56, which extends inside the gripper arms 22.1 and 22.1 and can be connected to either a source of suction air or a source of compressed air.

As soon as the yarn length F2 drops on the lower gripper 22, after the yarn length F1 is cut by means of the cutting sleeve 44, and after the upper adapter portion or inlet head 5' is raised upward away from the lower adapter portion 5, this yarn length F2 is sucked in through the opening 54 by a suction air current applied to the air channel 56. Subsequently, the flaps 55 are closed, with the yarn length F2 still remaining under the influence of the suction air current. The yarn length F3 extending to the residual yarn wind on a package or to one of the tubes 6' continues to be clamped by the gripper arms 22.1 and 22.2 in the region of the annular groove 5.3. Subsequently, the suction air current operative in the air channel 56 is disconnected, and compressed air is now supplied to the air channel 56, whereby the yarn F2 having a defined length is ejected from the air channel 56 and injected into the hollow shaft of the lower adapter portion of transport adapter 5. This change of position of the yarn length F2 is further assisted by a suction air current, which has meanwhile become operative inside the hollow spindle shaft and was built up by a yarn threading device, which is known for its use on two-for-one twisting spindles and operative inside the hollow spindle shaft in the fashion of an injector.

Thereafter, the lower adapter portion or transport adapter 5 is lifted out of the spindle by the upward movement of the gripper 22, and moved into the maintenance device B by the rotation of the gripper 22, where it is delivered to one of the two receiving and transport mandrels 100 shown in FIG. 1. These transport mandrels 100 are adapted to rotate about a vertical axis and to move upward and downward in vertical direction, in such a manner, that they allow both to transfer unwound units to the suspension holders for their removal, and to remove feed yarn package units comprising each a transport adapter 5 with two fully wound packages 6 each from a suspension holder and to transport same to the region of the spindles. The constructional elements for transferring and inserting a new feed yarn package unit into the spindle are not subject matter of the present invention, which relates only to the removal of fully unwound units, in particular from the protective pot of a two-for-one twisting spindle and to the further transportation of these unwound units to one of the mandrels 100, while simultaneously securing a remaining yarn end in the region of the hollow shaft of a package of transport adapter 5.

FIG. 9 shows again the transport or package adapter 5 loaded with empty or partially wound tubes 6'. It is engaged in a suspension holder 4, and it can be seen that the yarn end previously sucked into the center of the adapter is safely clamped between the suspension holder 4 and the edge of the upper opening of the package or transport adapter 5.

In order to be able to lift the gripper 22 together with the unwound unit (package or transport adapter with the two empty or almost empty tubes 6'), the suction device 23 together with the upper adapter portion or inlet head 5' is first rotated away from the region of the hollow spindle shaft. The upper adapter portion or the inlet head 5' is held by the upper gripper 37 until a feed yarn package unit comprising a package or transport adapter 5 with fully wound packages 6 loaded thereon is inserted again in the protective pot by means of the lower gripper 22. Thereupon, the upper gripper 37 moves again over the center of the spindle and places the inlet head or 1 upper adapter portion 5' on the lower adapter portion 5.

FIGS. 10 and 11 illustrate a modified embodiment for handling a bipartite package adapter, which can be composed of a lower adapter portion or transport adapter 5 and an upper adapter portion or yarn inlet head 5'. Also this embodiment includes a lower gripper 22, which comprises substantially two arms 22.2 and 22.2, and a suction device 23 with an associated or integrated, two-arm upper gripper 57. The upper gripper 57 has two pivotal arms, which are provided with inwardly directed projections 57.1 for engagement with an annular groove 5.1' of the yarn inlet head or upper adapter portion 5', in such a manner, that the arms of the upper gripper 57 are only in a point-contact engagement with the inlet head or upper adapter portion 5'.

In order to remove an unwound unit from a protective spindle pot, the lower gripper 22 and the suction device 23 with the integrated upper gripper 57 are swung out of the automatic maintenance device B over the spindle axis and moved downward in such a manner that the two grippers 22 and 57 are able to engage with the lower adapter portion 5 on the one hand and with the upper adapter portion or yarn inlet head 5' on the other. In so doing, the arms 22.1 and 22.2 of the lower gripper 22 clamp the yarn in the annular groove 5.3, while the yarn length F2 is freely movable in the region of the upper gripper 57. As soon as the grippers 22 and 57 are engaged with the two adapter portions 5 and 5' respectively, the suction device 23 with gripper 57 is moved upwardly, resulting in the position shown in FIG. 10. The suction device 23 with gripper 57 continues to rise until the yarn length F1 in the hollow spindle shaft which comprises here the additional yarn lengths F1' and F1'', has passed the yarn brake in the hollow spindle shaft which opened in the meantime.

Subsequently, a pivot lever 58 moves in the region of the lower gripper 22 from its position shown in dashed lines in FIGS. 10 and 11, in direction of arrow f8 to a position shown in solid lines, thereby jointly forming two loops of the yarn lengths F1, F1', F1'' and the yarn length F2 and guiding same to a cutting device 59. The yarn lengths are then cut, whereupon a suction air current operative in the suction line 25 of the suction device 23 removes the two yarn lengths F1 and F1'', and supplies same to a waste container not shown. The remaining yarn length F1' exiting from the lower adapter portion 5 or respectively the hollow spindle shaft is removed through the air channel 56 arranged in the lower gripper 22, whereas the yarn length F2 remaining between the yarn clamping point and the yarn cutting point is sucked into this air channel 56. The yarn length F2 is connected with the yarn length F3 extending to the almost unwound tube 6, The suction air current initially present in the air channel 56 is then switched over to a blowing air current such that the yarn length F2 first sucked into the air channel 56 is blown in direction of the spindle shaft. At the same time, a suction air current is generated in the region of the hollow spindle shaft by the actuation of a standard yarn threading device, which is arranged in the region of the hollow spindle shaft and operates in the fashion of an injector, so that the yarn length F2 is also sucked into the center of the lower portion of the package adapter 5.

Subsequently, after the suction device 23 has rotated away, the gripper 22 lifts the lower portion of the package adapter or transport adapter 5 out of the protective spindle pot and swings it into the automatic maintenance device B, where the package adapter or transport adapter 5 is further transported with the yarn end in a defined position and transferred in a manner comparable with the illustration of FIG. 9 to a suspension holder 4.

The remaining servicing work occurs in the manner described with reference to FIGS. 5–9.

While the description of the Figures is limited to the handling of one package adapter accommodating two cross-wound packages, the invention is also applicable to package adapters holding only one assembly-wound yarn package.

What is claimed is:

1. Method for securing a free end portion of yarn extending from a residual amount of yarn on a yarn package tube carried by a hollow carrier and transport adapter during removal thereof from a spindle assembly of a two-for-one twister textile yarn processing machine after processing of the yarn from the package to prepare the adapter and yarn package tube thereon for transport away from the spindle assembly; said method comprising the steps of cutting the free end portion of yarn extending from the yarn package tube to a desired length defining a terminal part, and inserting at least the terminal part of the cut length of the free end portion of yarn into the hollow interior of the carrier and transport adapter for securing the free end portion of yarn.

2. Method, as set forth in claim 1, further including clamping an intermediate part of the free end portion of yarn prior to and during said cutting step and said inserting step, and removing by suction the cut-off part of the free end portion of yarn.

3. Method, as set forth in claim 2, wherein the hollow yarn package carrier and transport adapter is of an axial upper and lower two piece construction in which at least the upper part contains therein a part of the free end portion of yarn during removal of the adapter from the spindle assembly and the lower piece carries the yarn package and receives the inserted terminal part of the cut free end portion of yarn for securing same, wherein said clamping step further includes clamping an intermediate part of the free end portion of yarn at the lower piece of the adapter; wherein said cutting step is performed at a part of the free end portion of yarn between the intermediate part which is clamped and the upper piece of the adapter; and further including separating the upper piece from the lower piece of the adapter prior to inserting the cut piece of the free end portion of yarn into the hollow interior of the adapter for securing the free end portion of yarn.

4. Method, as set forth in claim 3, wherein said clamping step further includes clamping an intermediate part of the free end portion of yarn prior to and during said cutting step at a second location at the upper piece of the adapter, wherein said cutting step is performed at a part of the free end portion of yarn between the clamped yarn parts, and further including removing the clamping at the upper piece of the adapter after the cutting step for performing the step of removing the cut-off part of the free end portion of yarn.

5. In a spindle assembly of a two-for-one twister textile yarn processing machine having a hollow spindle for passing of yarn therethrough during processing, and a hollow carrier and transport adapter removably positioned on said spindle and having an outer circumference with at least one hollow yarn supply package mounted thereon and defining an upper end extending above the yarn package; the combination therewith of means for removing the carrier and transport adapter from the spindle assembly after yarn processing of the supply package has been completed and for securing a free end portion of yarn which extends from a residual amount of yarn on the substantially empty yarn supply package and into the hollow spindle to prepare said adapter for transport away from said spindle assembly, said means including movable gripper arm means for moving to said spindle assembly and gripping said adapter on the outer circumference at an upper end thereof above said yarn package and for moving away from said spindle assembly for removing therefrom said adapter and substantially empty yarn supply package;

cutting means for cutting the free end portion of yarn extending from said substantially empty yarn supply package to a desired length defining a terminal part prior to removing said adapter and substantially empty yarn supply package from said spindle;

movable suction arm means for moving to said spindle assembly and into position at the upper end of said adapter and above said gripper means for removing the cut-off part of the free end portion of yarn after cutting thereof; and compressed air injector yarn threading means in said hollow spindle for being actuated for inserting at least the terminal part of the cut length of the free end portion of yarn into the hollow interior of said adapter for securing the free end portion of yarn.

6. In a spindle assembly, as set forth in claim 5, further including a plurality of said spindle assemblies positioned in side-by-side relationship longitudinally of said yarn processing machine, and a maintenance device means mounted for movement longitudinally along said yarn processing machine and to each of said spindle assemblies and for suction arm means for upward and downward movement in the vertical direction and inward and outward movement in the horizontal direction.

7. In a spindle assembly, as set forth in claim 5 or 6, in which said movable gripper arm means includes means for clamping an intermediate part of the free end portion of yarn.

8. In a spindle assembly, as set forth in claim 7, in which said gripper arm means includes two arms rotatable relative to each other and configured to close and substantially surround the outer circumferential surface of said adapter.

9. In a spindle assembly, as set forth in claim 8, in which said gripper arm means further includes a semicircular opening on an upper side of each of said gripper arms, movable flap means on each of said two arms for opening and closing said openings during and after cutting of the free end portion of yarn, and an air channel means extending from within said two arm means and said openings on said gripper arms through gripper arm means to a source of compressed air and a source of suction to cooperate with said air injection threading means to secure the cut length of the free end portion of yarn.

10. In a spindle assembly, as set forth in claim 8, in which said cutting means is mounted on one of said two arms and, includes pivotally mounted lever means for moving across said gripper arms to aid in positioning the free end of yarn in said cutting means, and pneumatic means for actuating said cutting means and said lever means.

11. In a spindle assembly, as set forth in claim 5 or 6, in which said cutting means is integrated into and forms a part of said movable suction arm means.

12. In a spindle assembly, as set forth in claim 11, in which said movable suction arm means includes a suction head adapted for positioning over the upper end of the package adapter and a suction line extending from said head and through said suction arm means to a source of suction, and in which said cutting means includes pneumatic actuation means and an air line extending from said actuation means through said suction arm means to an air source.

13. In a spindle assembly, as set forth in claim 11, in which said cutting means includes two spaced movable clamping sleeve means mounted coaxially in said suction arm means for clamping the free end portion of yarn at the upper end of said adapter and a movable cutting sleeve mounted coaxially with and between said clamping sleeve means for cutting the free end portion of yarn between and while clamped by said clamping sleeve means.

14. In a spindle assembly, as set forth in claim 13, in which said cutting means further includes spring means for biasing said clamping sleeve means and said cutting sleeve means out of clamping and cutting engagement, and pneumatic actuation means for moving said clamping sleeve means and said cutting sleeve means against the bias of said spring means for effecting clamping and cutting of the free end portion of yarn.

15. In a spindle assembly, as set forth in claim 14, in which said cutting means further includes means coupling said cutting sleeve with one of said clamping sleeves for movement therewith.

16. In a spindle assembly, as set forth in claim 15, in which said coupling means comprises a generally threadlike extending groove in an outer surface of said cutting sleeve, a recess in an inside wall of an outer one of said clamping sleeve means, and a spherical body positioned into rotary movement when said outer clamping sleeve is axially moved.

17. In a spindle assembly, as set forth in claim 5 or 6, wherein said carrier and transport adapter comprises axially-positioned hollow upper and lower pieces and in which said lower piece carries the hollow yarn package and receives said gripper means, and further including second gripper means mounted on said movable suction arm means for gripping said upper adapter piece.

18. In a spindle assembly, as set forth in claim 17, in which said second gripper means includes two arms rotatable relative to each other and configured to close and substantially surround an outer circumferential surface of said upper adapter piece and having inwardly directed projections to engage said upper adapter piece while providing space for passage of the free end portion of yarn without clamping thereof.

* * * * *

UNITED STATES PATENT AND TRADEMARK OFFICE

CERTIFICATE OF CORRECTION

PATENT NO. : 5,136,833

DATED : August 11, 1992

INVENTOR(S) : Siegfried Ingar

It is certified that error appears in the above-indentified patent and that said Letters Patent is hereby corrected as shown below:

On the title page, Under References Cited, Item [56]:

delete "6/1975" and insert --6/1974--

Col 3 line 68, before the word "and" insert --Figure 11 is a top view of one of the two maintenance--

Col 4 line 66, delete "6", and insert --6'--

Col 5 line 1, delete "6," and insert --6'--
line 8, delete "cabine-shaped" and insert --cabinet-shaped--
line 22, delete "s" and insert --8--
line 39, delete "22.2" (first occurrence) and insert --22.1--
line 48, delete "6" and insert therefor --6'--

Col 6 line 29, delete "Cutting" and insert --cutting--
line 39, delete "6," and insert --6'--

Col 7 line 36, delete "22.2" (first occurrence) and insert --22.1--
line 37, delete "22.2" (first occurrence) and insert --22.1--

Col 10 line 1 delete "22.2" and insert --22.1--

Col 11 line 17 delete "1"
line 24, delete "22.2" and insert --22.1--

Col 12 line 2 delete "6," and insert --6'.--

Col 13 line 52, after the word "for" insert --carrying said movable gripper arm means and said movable--

UNITED STATES PATENT AND TRADEMARK OFFICE

CERTIFICATE OF CORRECTION

PATENT NO. : 5,136,833

DATED : August 11, 1992

INVENTOR(S) : Siegfried Ingar

It is certified that error appears in the above-indentified patent and that said Letters Patent is hereby corrected as shown below:

Col 14 line 52, after the word "positioned" insert —in said groove and said recess for setting said cutting sleeve—

Signed and Sealed this

Twelfth Day of October, 1993

Bruce Lehman

*Attest:*

BRUCE LEHMAN

*Attesting Officer*

*Commissioner of Patents and Trademarks*